US008452197B2

(12) United States Patent
Tomatsu

(10) Patent No.: US 8,452,197 B2
(45) Date of Patent: May 28, 2013

(54) IMAGE FORMING DEVICE HAVING SHEET REVERSE RUNNING MECHANISM

(75) Inventor: Yoshiya Tomatsu, Kasugai (JP)

(73) Assignee: Banner & Witcoff, Ltd., Nagoya-shi, Aichi-ken (JP)

( * ) Notice: Subject to any disclaimer, the term of this patent is extended or adjusted under 35 U.S.C. 154(b) by 569 days.

(21) Appl. No.: 12/709,608

(22) Filed: Feb. 22, 2010

(65) Prior Publication Data

US 2010/0247117 A1 Sep. 30, 2010

(30) Foreign Application Priority Data

Mar. 26, 2009 (JP) ..... 2009-076790
Mar. 26, 2009 (JP) ..... 2009-076791

(51) Int. Cl.
*G03G 15/00* (2006.01)

(52) U.S. Cl.
USPC ..... 399/21; 399/18

(58) Field of Classification Search
USPC ..... 399/21
See application file for complete search history.

(56) References Cited

U.S. PATENT DOCUMENTS 5,708,954 A * 1/1998 Ando et al. ..... 399/402
6,019,362 A 2/2000 Yazawa
7,158,734 B2 * 1/2007 Kawamata et al. ..... 399/91
7,429,995 B2 * 9/2008 Sato et al. ..... 347/156
7,540,492 B2 * 6/2009 Miyazaki ..... 271/153
7,778,556 B2 * 8/2010 Ohkawa et al. ..... 399/27
7,881,622 B2 * 2/2011 Sayama et al. ..... 399/21
2005/0174419 A1 * 8/2005 Kitazawa et al. ..... 347/118
2006/0159485 A1 * 7/2006 Nishimura et al. ..... 399/109
2006/0193646 A1 * 8/2006 Suzuki et al. ..... 399/12
2006/0193666 A1 8/2006 Tomatsu
2006/0280530 A1 * 12/2006 Andoh ..... 399/301
2007/0058993 A1 * 3/2007 Horinoe ..... 399/13
2007/0223947 A1 * 9/2007 Ohkawa et al. ..... 399/27

FOREIGN PATENT DOCUMENTS

JP 05-178493 7/1993
JP 10-194520 7/1998
JP 10-226134 8/1998
JP 11-143153 5/1999
JP 2001-177687 6/2001
JP 2002-145504 5/2002
JP 2004217336 A 8/2004

(Continued)

OTHER PUBLICATIONS

Office action for Japanese patent application No. 2009-076790 mailed Mar. 15, 2011.

*Primary Examiner* — Anthony Nguyen
(74) *Attorney, Agent, or Firm* — Banner & Witcoff, Ltd.

(57) ABSTRACT

An image forming device includes a changeover flap, a cover, a flap displacement mechanism, an inlet end, an outlet end, and a first conveyer passage extending from the outlet end. A second conveyer passage is bifurcated from the first conveyer passage at a bifurcated portion. The changeover flap is provided at the bifurcated portion and is pivotally movable. The flap displacement mechanism includes a pivot arm pivotally movable. The pivot arm includes a free end portion provided with a linking portion to which the changeover flap is pivotally movably connected. The pivot arm and the changeover flap is configured to change an angle therebetween in accordance with a pivotal movement of the changeover flap and the pivot arm in interlocking relation to the pivotal movement of the cover from its closed position to its open position to displace the linking portion toward the cover.

19 Claims, 14 Drawing Sheets

FOREIGN PATENT DOCUMENTS

| | | |
|---|---|---|
| JP | 2006-058439 | 3/2006 |
| JP | 2006-240765 | 9/2006 |
| JP | 2007-191232 | 8/2007 |
| JP | 2008-120534 | 5/2008 |
| JP | 2008225275 A | 9/2008 |

* cited by examiner

IMAGE FORMING DEVICE HAVING SHEET REVERSE RUNNING MECHANISM

CROSS REFERENCE TO RELATED APPLICATION

This application claims priorities from Japanese Patent Application Nos. 2009-076790 filed Mar. 26, 2009 and 2009-076791 filed Mar. 26, 2009. The entire content of each of these priority applications is incorporated herein by reference.

TECHNICAL FIELD

The present invention relates to an image forming device for printing an image on adverse side and back side of a sheet.

BACKGROUND

In a printer capable of forming an image on an adverse side and a back side of a sheet, a reverse-running mechanism is provided for reversing a conveying direction of a sheet already formed with an image on its adverse side and then directing the sheet to an inlet side of an image forming unit to form an image on a back side of the sheet.

In such a conventional printer, a first sheet passage extends from an outlet side of the image forming unit to the reverse-running mechanism, and a second sheet passage extends from the reverse-running mechanism to the inlet side of the image forming unit. A pivotally movable changeover flap is provided at a bifurcate portion between the first and second sheet passages for selectively shutting off the one of the first and second sheet passages.

An opening portion is formed in a frame for partly opening the second sheet passage in order to remove a sheet jammed at the second sheet passage. A cover is pivotally movably provided to the frame for opening and closing the opening portion. The changeover flap is provided at the cover, and the second sheet passage is defined between an inner surface of the cover and the changeover flap. (0007B front half) Further, sheet sensors are provided to detect a sheet passing through the first and second sheet passages.

SUMMARY

Inventors found that another sensor is required for detecting opening and closing state of the cover. However, the numbers of parts and components such as sensors and actuators may be increased. (0005A,0006) Further, the sheet jamming occurring at the second sheet passage is caused by nipping the sheet between the rear cover and the changeover flat. If the cover opens to remove the jammed sheet, unwanted force may be applied to the changeover flap and the jammed sheet, so that the flap may be broken to lower or bang up the operation of the image forming device.

In view of the foregoing, it is an object of the invention to provide an image forming device capable of protecting the flap.

Another object of the invention is to provide an image forming device capable of detecting passing of the sheet through the first and second sheet passages as well as detecting opening and closing state of the cover, while restraining an increase in the numbers of parts and components.

These and other objects of the invention will be attained by an image forming device that forms an image on adverse side and back side of a sheet.

The image forming device includes an image forming unit, a reverse-running mechanism, a changeover flap, a frame, a cover, and a flap displacement mechanism. The image forming unit forms an image on the sheet. The image forming unit includes an inlet end and an outlet end. A first conveyer passage extends from the outlet end to discharge the sheet out of the image forming unit. The reverse-miming mechanism is positioned at the first conveyer passage to invert a feeding direction of the sheet having been conveyed along the first conveyer passage. A second conveyer passage is bifurcated from the first conveyer passage at a bifurcated portion and reaching the inlet end. The changeover flap is provided at the bifurcated portion and is pivotally movable to a first position closing the first conveyer passage while opening the second conveyer passage and to a second position closing the second conveyer passage while opening the first conveyer passage. The changeover flap includes a tip end portion. The frame accommodates therein the image forming unit, the reverse-running mechanism, and the changeover flap. The frame includes an opening at which at least a part of the second conveyer passage is exposed to an outside. The cover is pivotally movable between a closed position closing the opening and an open position opening the opening. The cover defines a part of the second conveyer passage at the closed position. The flap displacement mechanism includes a pivot arm pivotally movable in interlocking relation to the pivotal movement of the cover. The pivot arm includes a portion provided with a pivot shaft at a position opposite to the cover with respect to the second conveyer passage and a free end portion provided with a linking portion to which the changeover flap is pivotally movably connected. The pivot arm and the changeover flap is configured to change an angle therebetween in accordance with the pivotal movement of the changeover flap and the pivot arm in interlocking relation to the pivotal movement of the cover from its closed position to its open position to displace the linking portion toward the cover.

In another aspect of the invention, there is provided an image forming device that forms an image on adverse side and back side of a sheet. The image forming device includes an image forming unit, a reverse-running mechanism, a changeover flap, a frame, a cover, a flap displacement mechanism, a flap sensor, and a determination device. The image forming unit forms an image on the sheet. The image forming unit includes an inlet end and an outlet end. A first conveyer passage extends from the outlet end to discharge the sheet out of the image forming unit. The reverse-running mechanism is positioned at the first conveyer passage to invert a feeding direction of the sheet having been conveyed along the first conveyer passage. A second conveyer passage is bifurcated from the first conveyer passage at a bifurcated portion and reaching the inlet end. The changeover flap is provided at the bifurcated portion and is pivotally movable to a first position closing the first conveyer passage while opening the second conveyer passage and to a second position closing the second conveyer passage while opening the first conveyer passage, the changeover flap having a tip end portion. The frame accommodates therein the image forming unit, the reverse-running mechanism, and the changeover flap. The frame includes an opening at which at least a part of the second conveyer passage is exposed to an outside. The cover is pivotally movable between a closed position closing the opening and an open position opening the opening. The cover defines a part of the second conveyer passage at the closed position. The flap displacement mechanism is configured to displace the changeover flap to open one of the first conveyer passage and the second conveyer passage when the cover is opened.

The flap sensor performs detection as to whether or not the changeover flap shuts off one of the first conveyer passage and the second conveyer passage. The determination device determines, based on the detection, whether or not the sheet has moved past one of the first conveyer passage and the second conveyer passage and determines whether or not the cover is opened.

DETAILED DESCRIPTION

Figure 1:
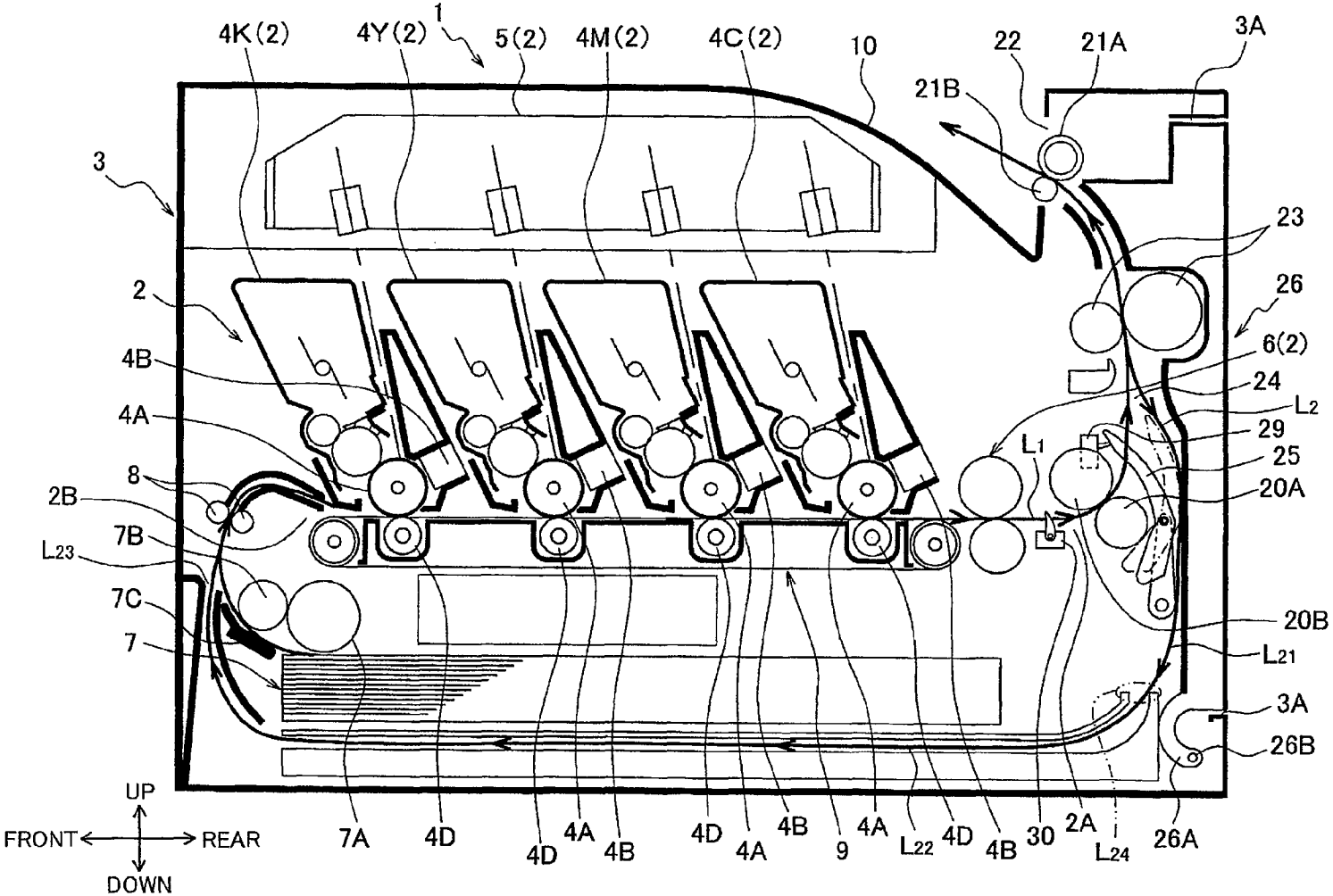
FIG. 1 is a schematic cross-sectional view of an image forming device according to one embodiment of the invention.

An image forming device according to one embodiment of the invention will be described with reference to the FIGS. 1 through 14 wherein like parts and components are designated by the same reference numerals to avoid duplicating description. The embodiment pertains to an electro-photographic type laser printer The terms "upward", "downward", "upper", "lower", "above", "below", "beneath", "right", "left", "front", "rear" and the like will be used throughout the description assuming that the laser printer is disposed in an orientation in which it is intended to be used.

As shown in FIG. 1, the laser printer 1 includes a box shaped outer frame 3 in which an image forming unit 2 is provided for forming an image on a sheet such as a cut paper sheet and an OHP sheet. The image forming unit 2 includes four process cartridges 4K, 4Y, 4M, 4C, an exposure unit 5 and a fixing unit 6. The four process cartridges 4K, 4Y, 4M and 4C are used for four different developing agents (toners) of black, yellow, magenta and cyan, respectively. The image forming unit 2 is of a direct tandem type in which a color image is formed on a sheet by superimposing four different toner images with one another. Each process cartridge includes a photosensitive drum 4A that carries a toner image, and a charger 4B for charting the photosensitive drum 4A.

A feeder unit includes a sheet cassette 7, a pickup roller 7A, a separation roller 7B, a separation pad 7C for supplying each one of the sheets toward the image forming unit 2. A pair of registration rollers 8 are provided downstream of the feeder unit in a sheet feeding direction for correcting diagonal feeding of the sheet. A transfer belt 9 is provided downstream of the registration rollers 8, and transfer rollers 4D are provided opposite to the respective photosensitive drums 4A with respect to the transfer belt 8. The fixing unit 6 is provided downstream of the image forming unit 2. Each toner image on each photosensitive drum 4A is transferred onto the sheet conveyed on the transfer belt 9, and the toner image is thermally fixed to the sheet upon passing the sheet through the fixing unit 6.

A both sides printing mechanism will be described with reference to FIGS. 1 through 3. The outer frame 3 has an upper portion functioning as a sheet discharge tray 10, and is formed with a sheet discharge opening 22 in communication with the discharge tray 10. The image forming unit 2 has an outlet end 2A at a downstream side of the fixing unit 6. A first conveyer passage L1 is defined from the outlet end 2A to the discharge opening 22. The first conveyer passage L1 has a U-shaped configuration such that the passage is upwardly curved by 180 degrees from the outlet end 2A.

A first conveyer roller 20A is provided adjacent to the outlet end 2A, and a second conveyer roller 21A is provided adjacent to the discharge opening 22. A first pinch roller 20B is positioned in opposition to the first conveyer roller 20A nippingly interposing the sheet therebetween. The first pinch roller 20B is a follower roller rotatable upon conveying the sheet. A second pinch roller 21B is positioned in opposition to the second conveyer roller 21A nippingly interposing the sheet therebetween. The second pinch roller 21B is a follower roller rotatable upon conveying the sheet. A pair of intermediate rollers 23 are provided at the first conveyor passage L1 and between the first and second conveyer rollers 20A and 21A for removing a curling nature of the sheet discharged out of the fixing unit 6.

The second conveyer roller 21A is rotatable in a normal direction for conveying the sheet toward the discharge tray 10, and in a reverse direction for conveying the sheet to a direction away from the discharge tray 10. For a single side printing only, after the image is formed on the sheet at the image forming unit 2, the sheet is conveyed by the first and second conveyer rollers 20A, 21A to the discharge tray 10 through the first conveyer passage L1 and the discharge opening 22. On the other hand, for both sides printing, after a trailing end of the sheet already formed with an image at an adverse side of the sheet reaches the second conveyor roller 21A, the second conveyer roller 21A changes its rotating direction to the reverse direction, so that the sheet can be conveyed to a second conveyer passage L2.

The second conveyer passage L2 is adapted for directing the sheet reversed by the second conveyer roller 21B toward an inlet end 2B of the image forming unit 2. To this effect, the second conveyer passage L2 includes a first vertical passage section L21 extending downward from a bifurcated portion 24 from the first conveyer passage L1, a horizontal passage section L22 extending horizontally from a lower portion of the first vertical passage section L21 at a position immediately below the sheet cassette 7, and a second vertical passage section L23 extending from an exit end portion of the horizontal passage section L22 to the registration rollers 8 and to the inlet end 2B of the image forming unit 2.

A passage section from the bifurcated portion 24 to the discharge opening 22 commonly functions as the first conveyer passage L1 as well as the second conveyer passage L2. Therefore, a leading end of the sheet reversely fed by the second conveyer roller 21A may not be directed exclusively to the first vertical passage section L21 of the second conveyer passage L2, but may be directed to the first conveyer roller 20A.

To avoid this, a changeover flap 25 is provided at the bifurcated portion 24 in order to selectively shut-off one of the first and second conveyer passages L1 and L2. The changeover flap 25 is pivotally movable to one of a first pivot position and a second pivot position. In the first pivot position, the changeover flap 25 opens the first conveyer passage L1 and closes the second conveyer passage L2 to discharge the sheet from the image forming section 2 to the discharge tray 10 as shown in FIG. 2. In the second pivot position, the changeover flap 25 closes the first conveyer passage L1 and opens the second conveyer passage L2 to direct the sheet reversely fed by the second conveyer roller 21A to the first vertical passage section L21 as shown in FIG. 3.

The outer frame 3 has a rear portion formed with an opening 3A that opens a part of the second conveyer passage L2. The opening 3A has a lower end horizontally aligned with an inlet portion L24 of the horizontal passage section L22.

A rear cover 26 is pivotally movably connected to a main frame (not shown) provided in the outer frame 3 for opening and closing the opening 3A. The main frame accommodates therein the image forming unit 2. The inlet portion L24 of the horizontal passage section L22 is a lowermost end portion of a chute frame 27 (described later) provided at the main frame, the chute frame 27 being in confrontation with the rear cover 26 to define the first vertical passage section L21.

Figure 2:
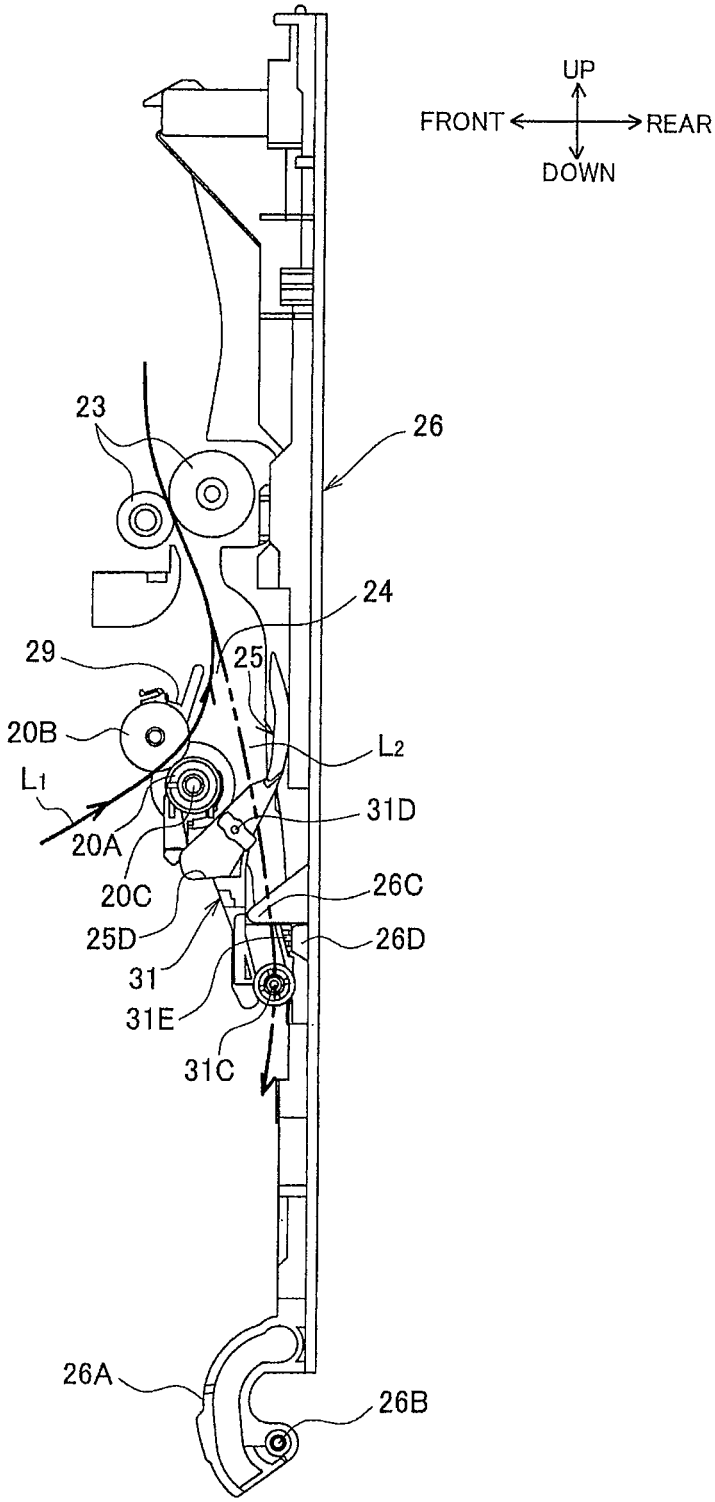
FIG. 2 is a view for description of positional relationship among a rear cover, a changeover flap and a holder arm at a closed position of the rear cover and showing closing state of a second conveyer passage in the image forming device according to the embodiment.
Figure 3:
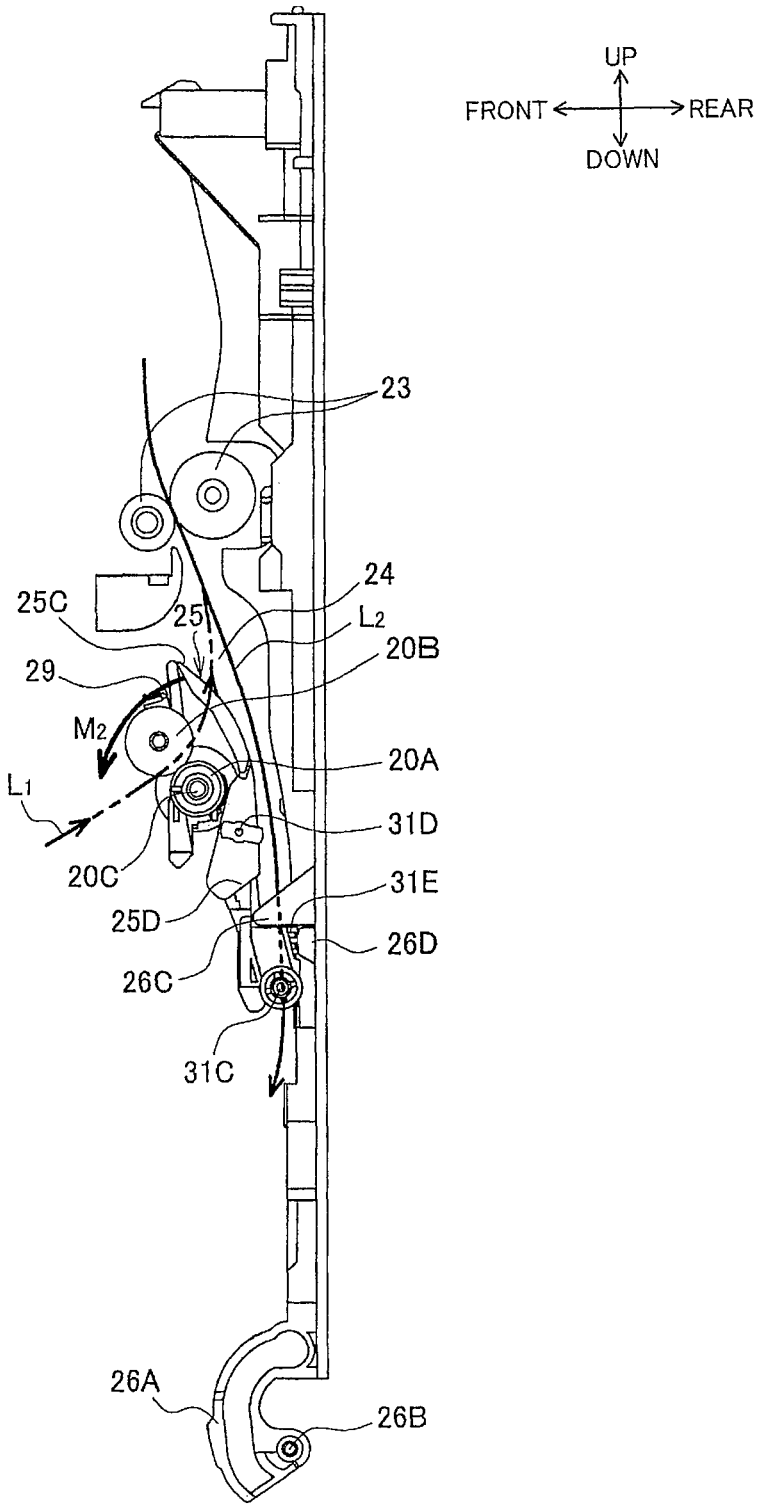
FIG. 3 is a view for description of the positional relationship among the rear cover, the changeover flap and the holder arm at the closed position of the rear cover and showing closing state of a first conveyer passage in the image forming device according to the embodiment.
Figure 4:
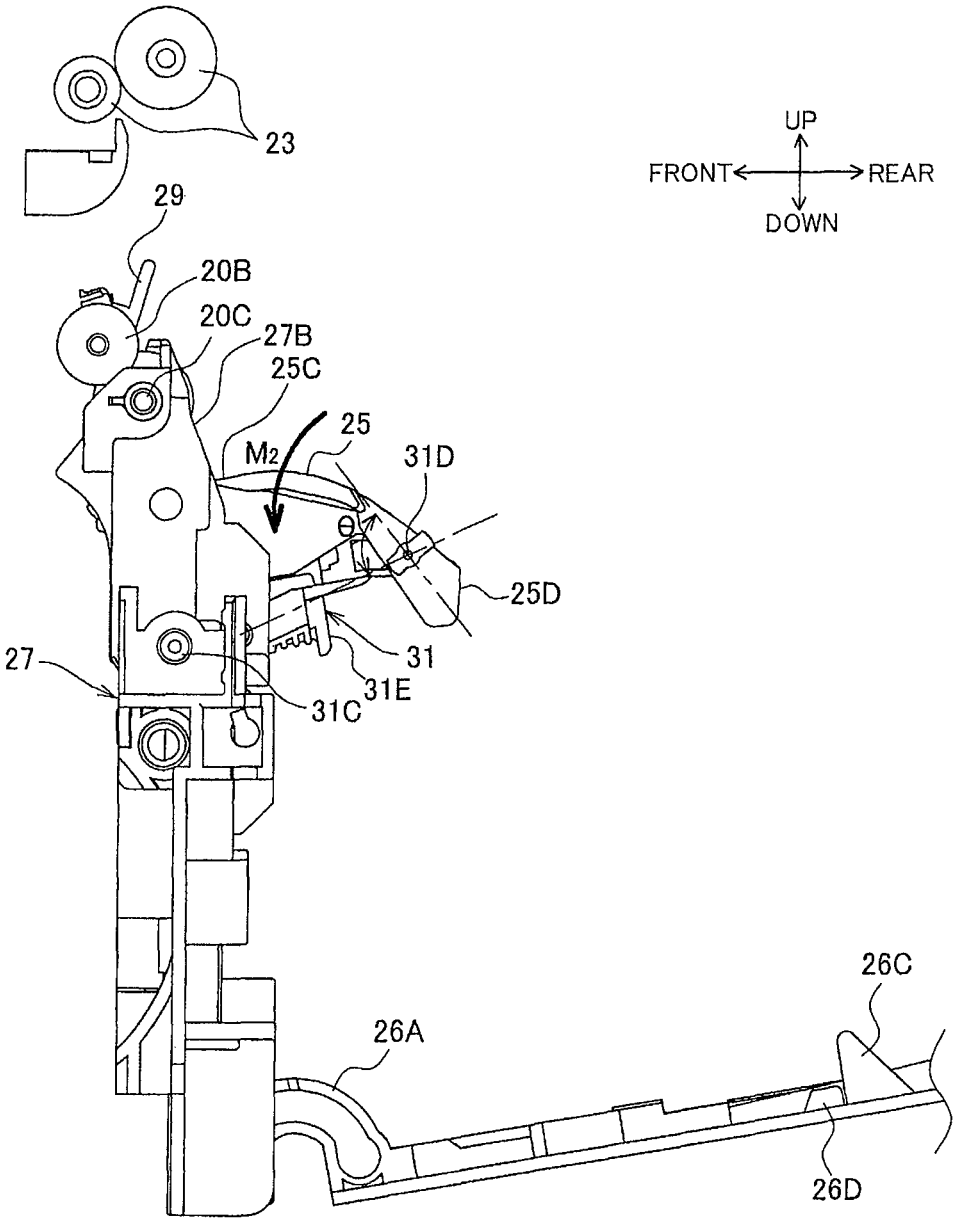
FIG. 4 is a view for description of the positional relationship among the rear cover, the changeover flap and the holder arm at an open position of the rear cover in the image forming device according to the embodiment.

The rear cover 26 is pivotally movable between a closing position shown in FIG. 2 for closing the opening 3A and an opening position shown in FIG. 4 for opening the opening 3A. At the closing position, the rear cover 26 provides a sheet conveying surface of a part of the second conveyer passage L2 (the first vertical passage section L21) as shown in FIGS. 1 through 3.

Figure 5:
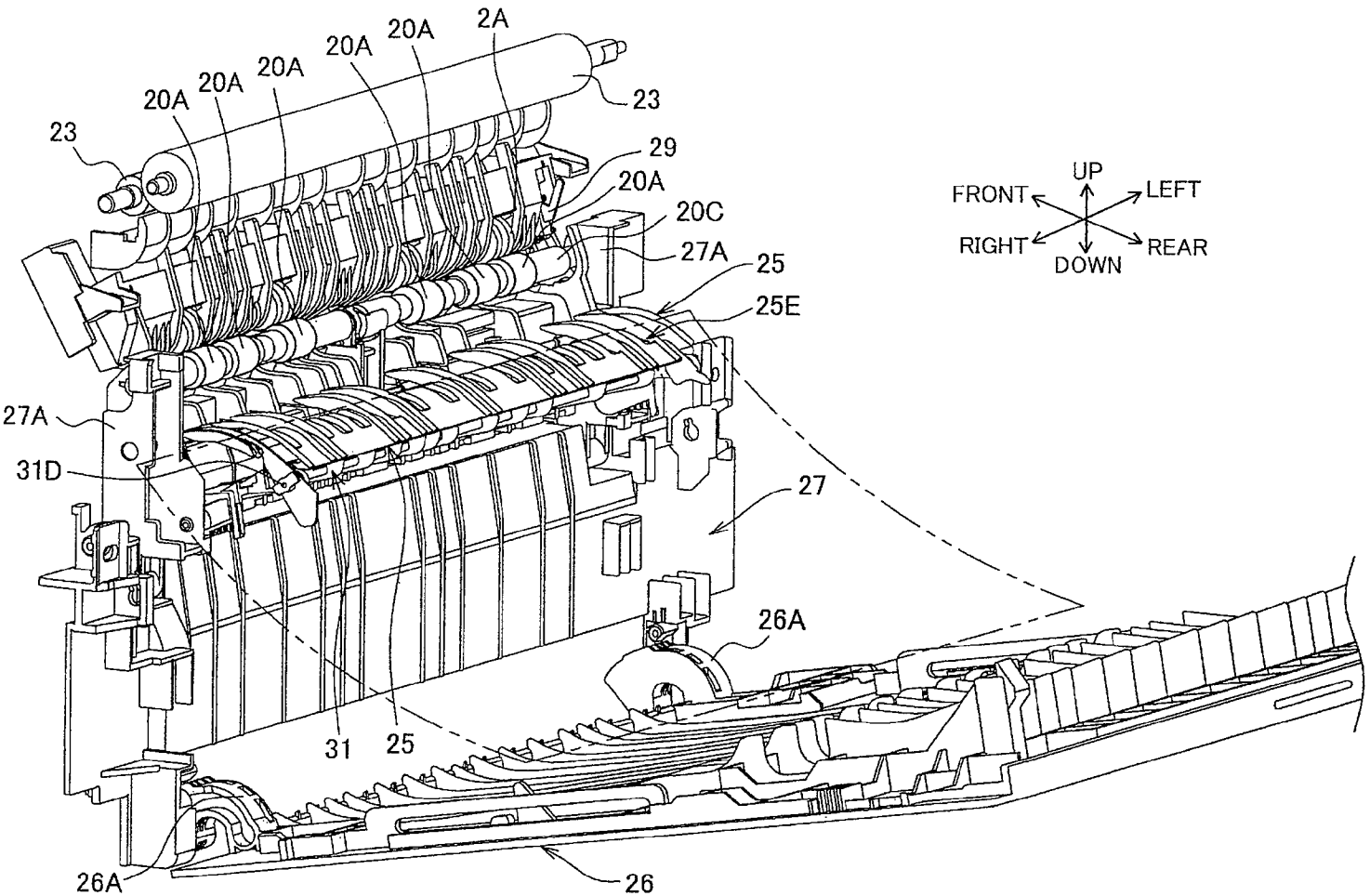
FIG. 5 is a perspective view for description of the positional relationship among the rear cover, the changeover flap and the holder arm at the open position of the rear cover in the image forming device according to the embodiment.

As shown in FIGS. 2 and 5, the rear cover 26 has a lower portion provided with a C-shaped hinged portion 26A pivotally supported to a lower end portion of the chute frame 27 through a pivot shaft 26B. The pivot shaft 26B is positioned lower than the inlet portion L24 as shown in FIG. 1.

The chute frame 27 is fixed to the main frame (not shown) and is positioned in confrontation with the rear cover 26 with a predetermined space therebetween when the latter is closed. Thus, the chute frame 27 provides the sheet conveying surface of the first vertical passage section L21 in cooperation with the rear cover 26.

Incidentally, the main frame and the outer frame 3 constitute a main body of the printer 1. The main frame is constituted by side frames spaced away from each other in a widthwise direction (lateral direction), and a beam frame extending in the widthwise direction for connecting the side frames to each other.

Figure 6:
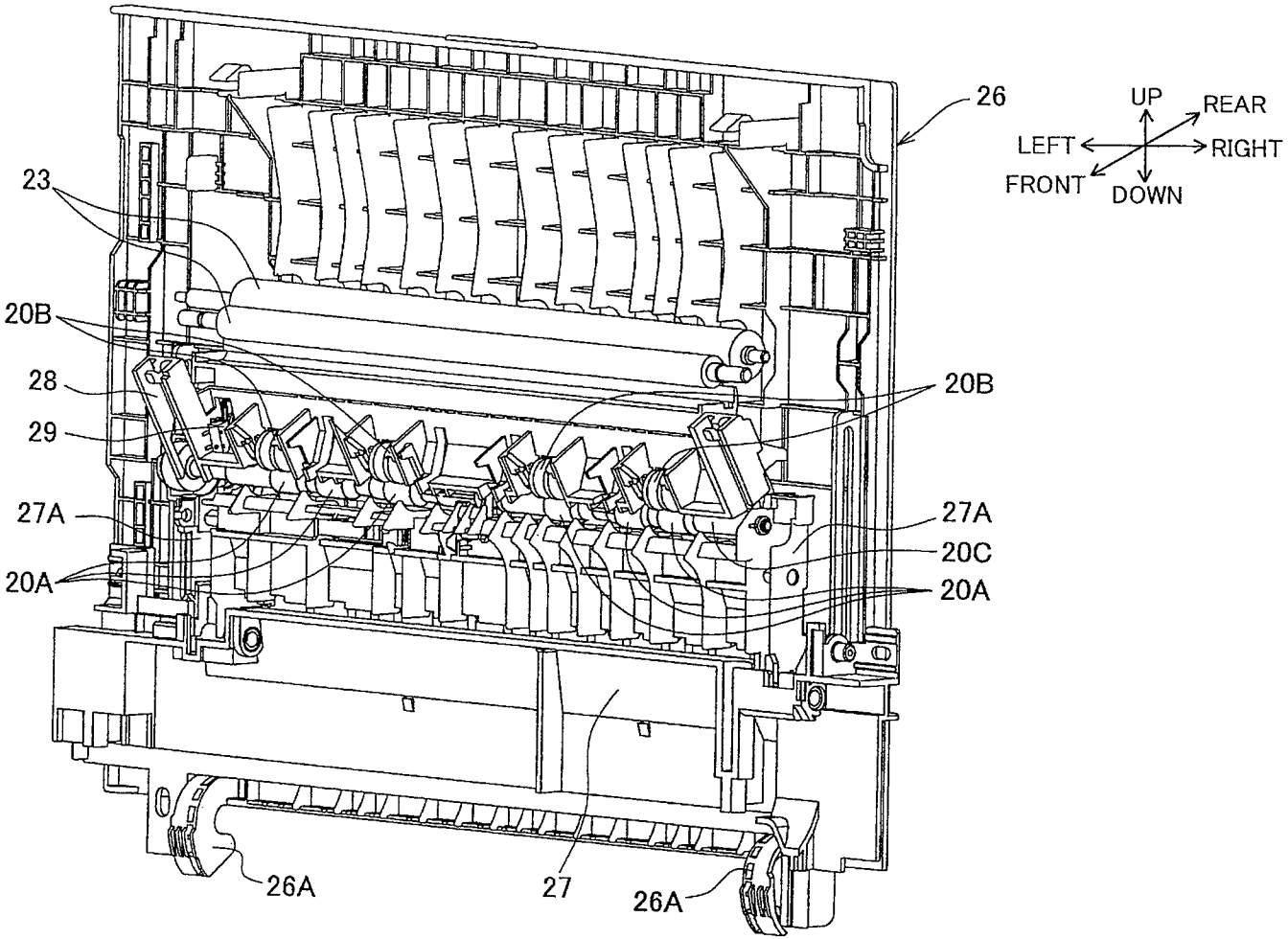
FIG. 6 is a perspective view as viewed from an internal portion of the image forming device for description of the positional relationship among the rear cover, the changeover flap and the holder arm at the open position of the rear cover in the image forming device according to the embodiment.

A support frame 27A is integrally provided at each widthwise upper end portion of the chute frame 27 as shown in FIG. 6 for rotatably supporting a rotation shaft 20C of the first conveyer roller 20A. On the other hand, the side frames are assembled with a roller holder 28 holding the first pinch roller 20B.

Here, the first conveyer roller 20A includes a plurality of conveyer roller sections drivingly rotated integrally upon rotation of the rotation shaft 20C. On the other hand, the first pinch roller 20B includes a plurality of pinch roller sections rotationally driven independently of one another. Each rotation shaft of each pinch roller section is subjected to biasing force by each urging member (not shown) to permit each pinch roller section to be displaceable independent of each other.

The roller holder 28 is provided with a flap sensor 29 that detects closing position of the changeover flap 25 with respect to either one of the first conveyer passage L1 and the second conveyer passage L2. The flap sensor 29 is rendered ON in a state where a tip end portion of the changeover flap 25 is brought into contact with the flap sensor 29 upon closure of the first conveyer passage L1 by the changeover flap 25 as shown in FIG. 3. The flap sensor 29 is rendered OFF in a state where the tip end portion of the changeover flap 25 is positioned away from the flap sensor 29 upon opening of the first conveyer passage L1 by the changeover flap 25 as shown in FIGS. 2 and 4.

A sheet sensor 30 is provide at a position between the fixing unit 6 and the first conveyer roller 20A and upstream of the bifurcated portion 24 with respect to the first conveyer passage L1 as shown in FIG. 1. The sheet sensor 30 is adapted for detecting passing of the sheet discharged from the fixing unit 6. That is, the sheet sensor 30 is rendered ON in a state where the sheet is passing through the sheet sensor 30, and is rendered OFF in a state where no sheet is passing through the sheet sensor 30.

Figure 7:
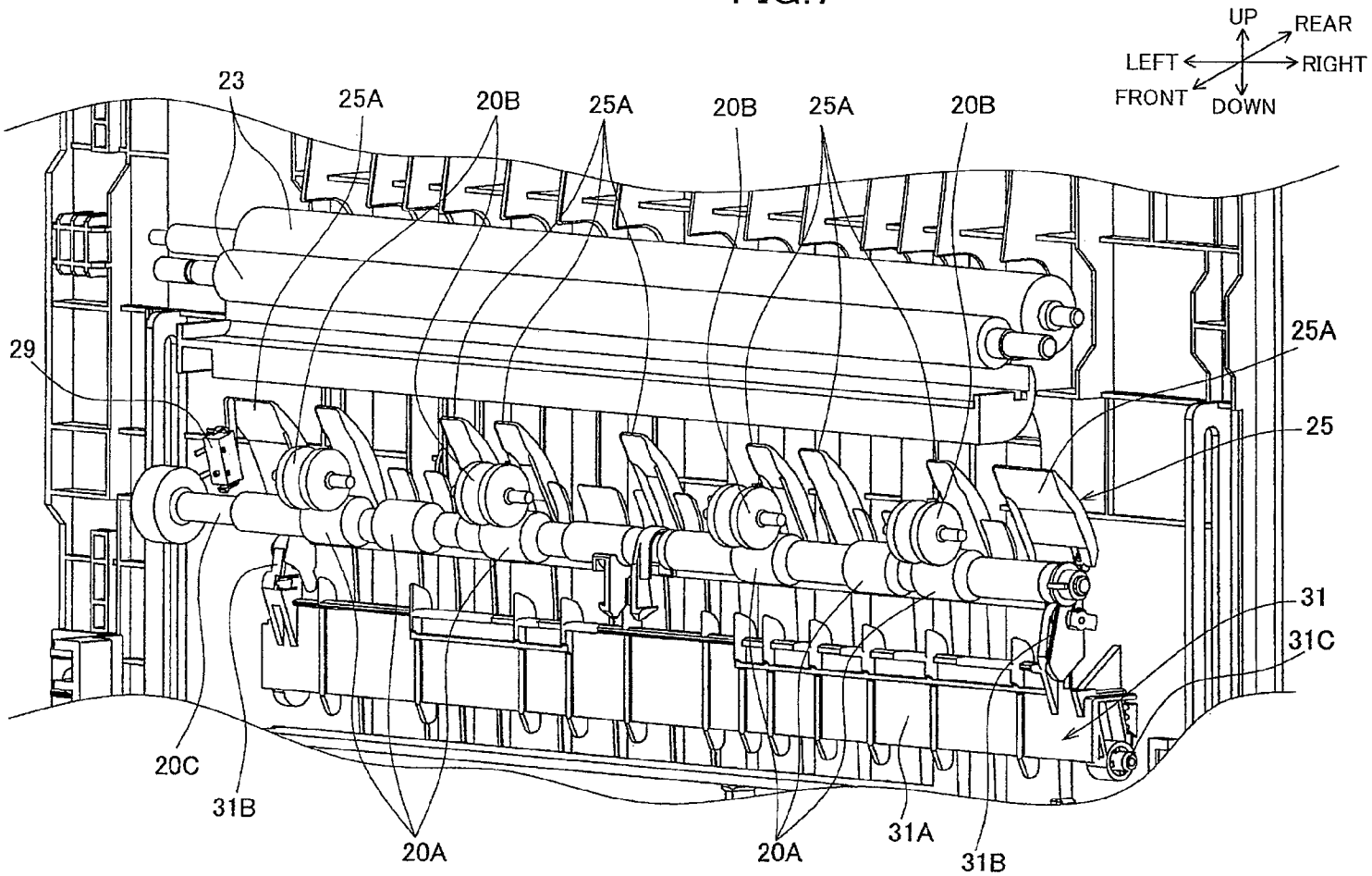
FIG. 7 is a partial perspective view the same as FIG. 6, but a roller holder shown in FIG. 6 is omitted.
Figure 8:
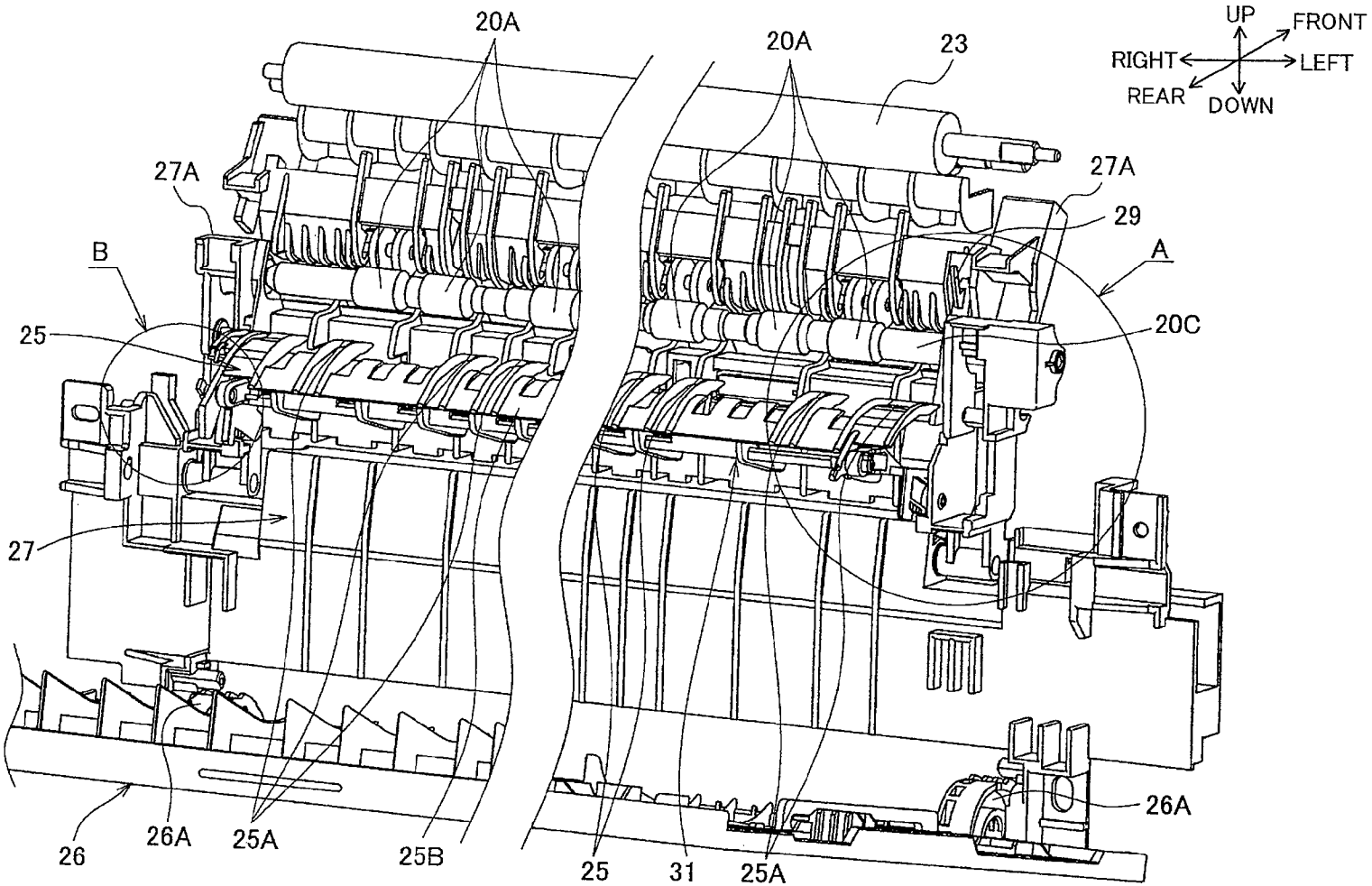
FIG. 8 is a perspective view as viewed from a rear side of the image forming device for description of the positional relationship among the rear cover, the changeover flap and the holder arm at the closed position of the rear cover in the image forming device according to the embodiment.
Figure 11:
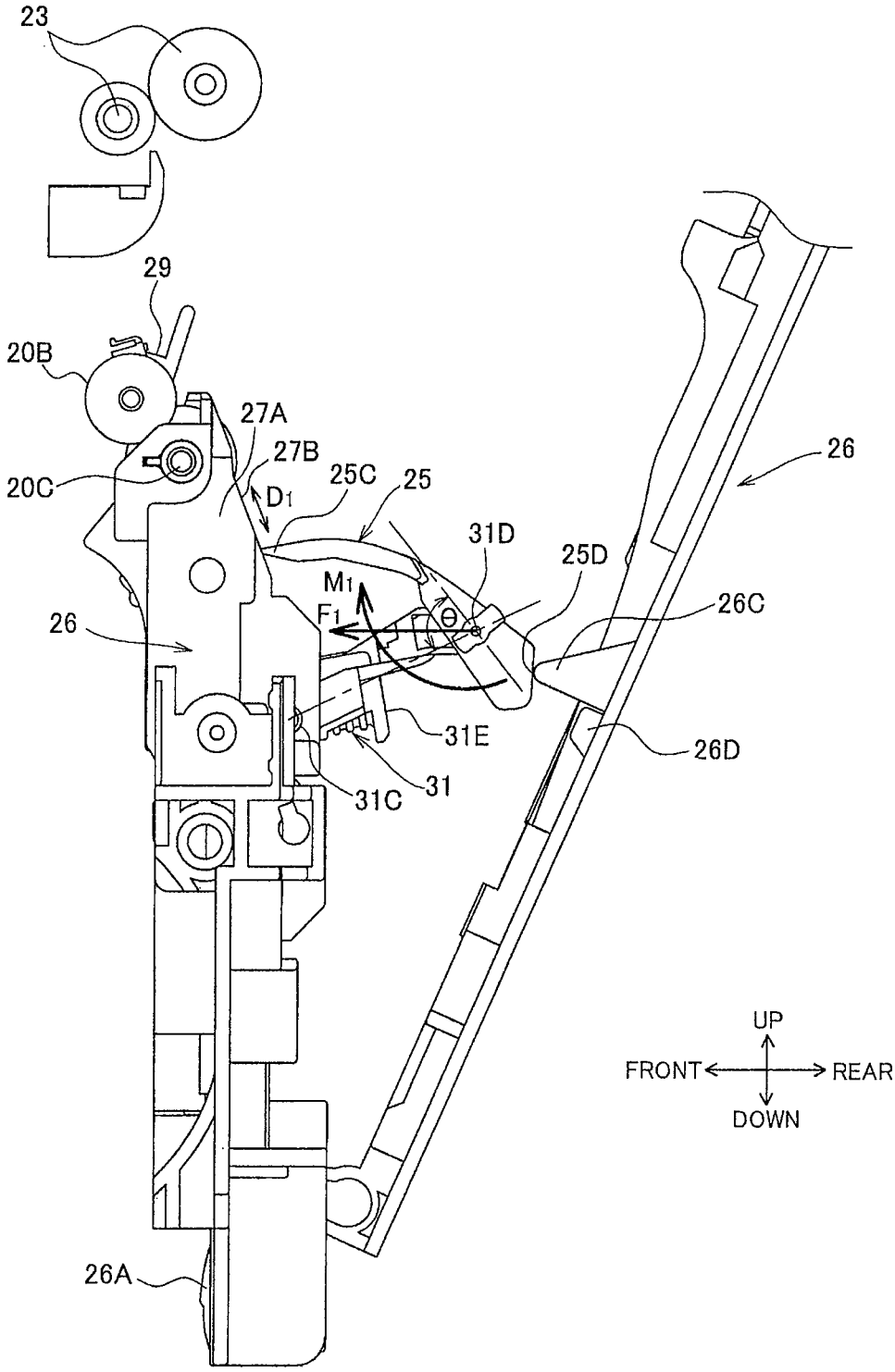
FIG. 11 is a view for description of the positional relationship among the rear cover, the changeover flap and the holder arm when the rear cover is on its way to the open position or closed position in the image forming device according to the embodiment.
Figure 12:
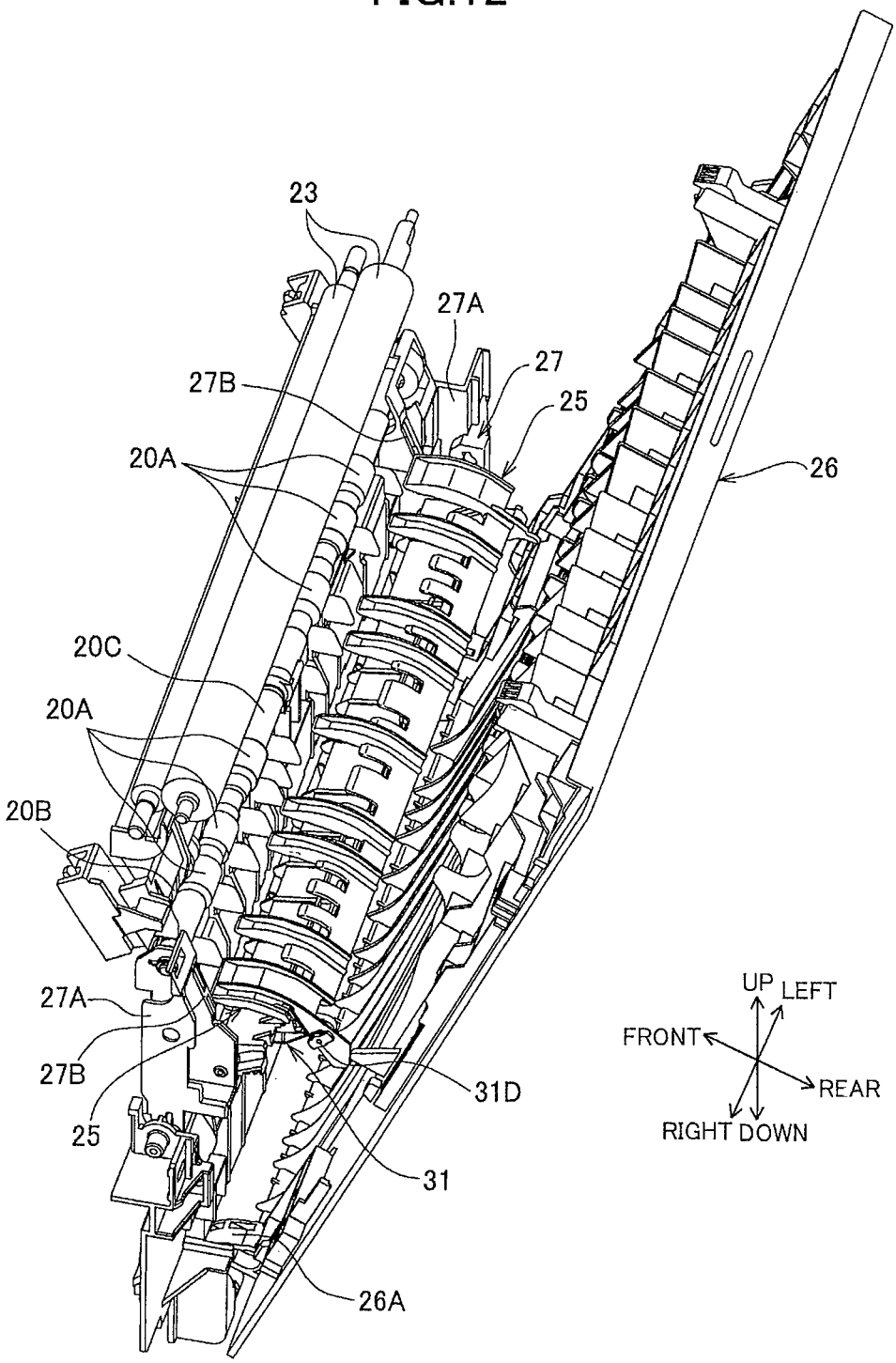
FIG. 12 is a perspective view as viewed from above the image forming device for description of the positional relationship among the rear cover, the changeover flap and the holder arm when the rear cover is on its way to the open position or closed position in the image forming device according to the embodiment.

A details of the changeover flap 25 will next be described. The changeover flap 25 includes a plurality of fin bodies 25A arrayed in the widthwise direction (in a direction perpendicular to the sheet feeding direction) as shown in FIG. 7, and a flap body 25B having an arcuate cross-section and extending in the widthwise direction as shown in FIG. 8. The fin bodies 25A and the flap body 25B are integrally with each other and are made from a resin. The changeover flap 25 has a tip end portion 25C and a first pressed portion 25D (FIG. 11).

Figure 9:
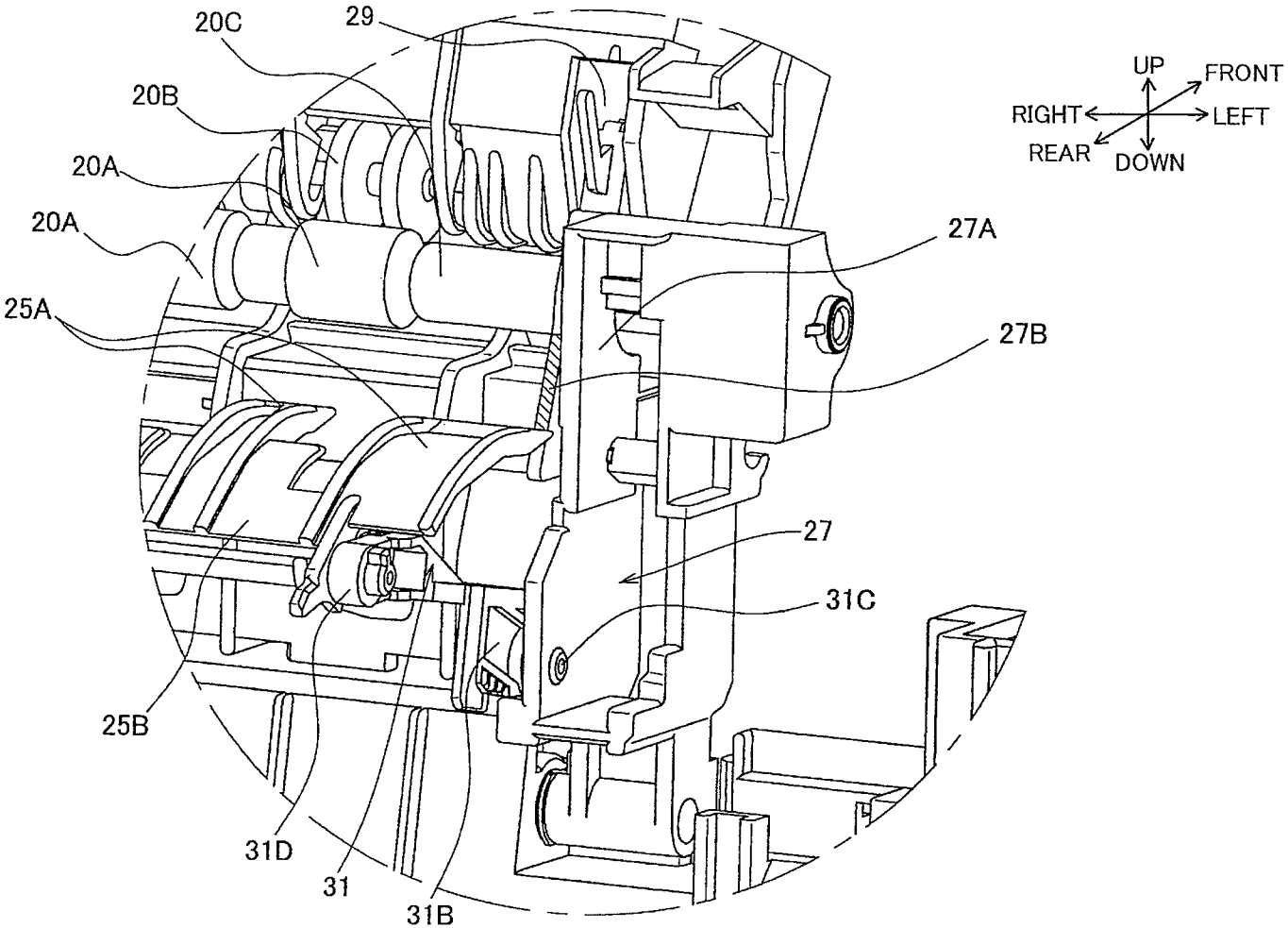
FIG. 9 is an enlarged partial perspective view of a portion encircled by IX in FIG. 8.
Figure 10:
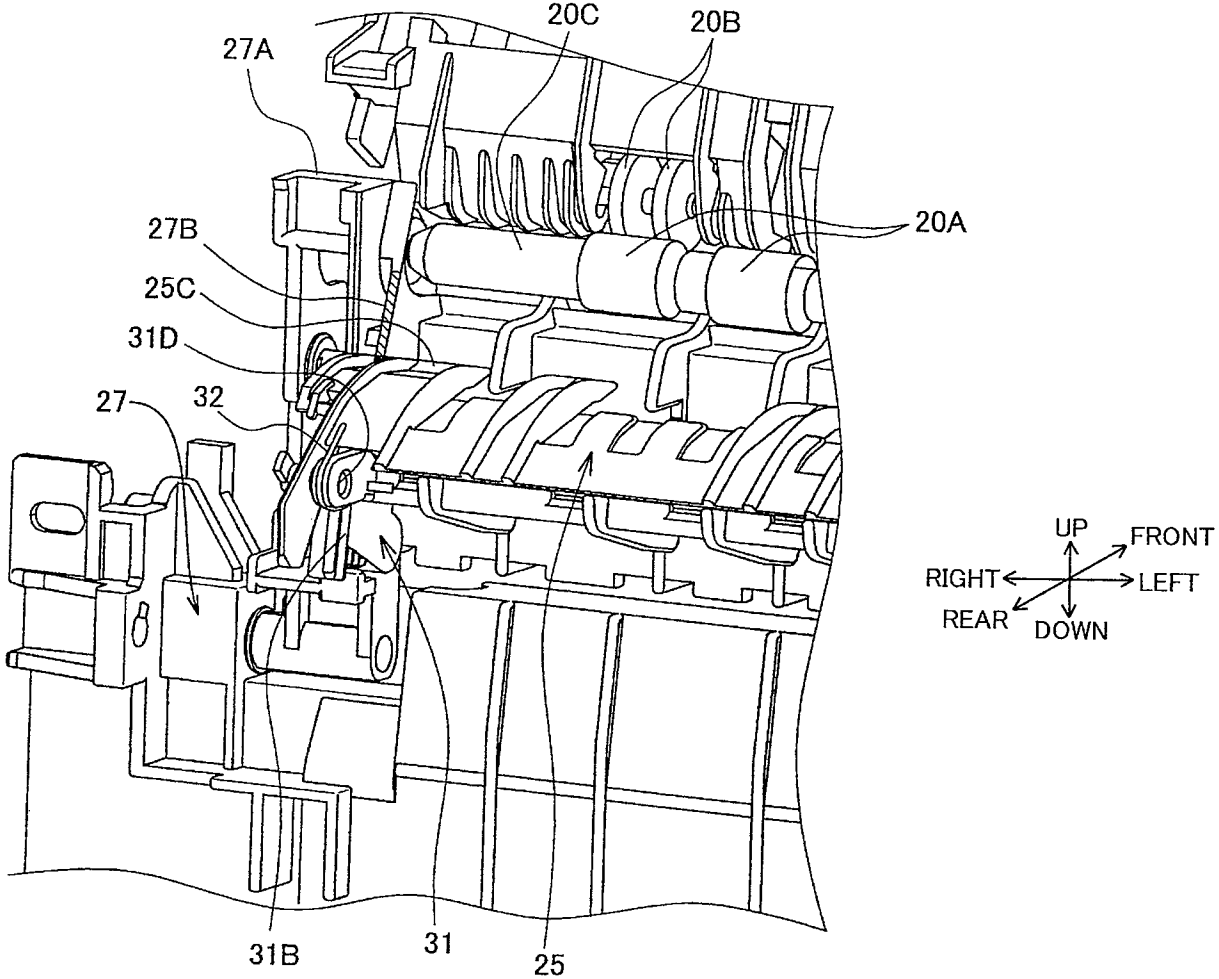
FIG. 10 is an enlarged partial perspective view of a portion encircled by X in FIG. 8.

As shown in FIGS. 9 and 10, a holder arm is pivotally movably connected to the chute frame 27, and the flap body 25B has longitudinal end portions each pivotally movably connected to the holder arm 31.

As shown in FIG. 7, the holder arm 31 includes a main body portion 31A, arm portions 31B, and a pivot shaft portion 31C. The main body portion 31A is a strip shaped and extends in the widthwise direction. Each arm portion 31B is provided at each widthwise end portion of the main body portion 31A and extends in a direction perpendicular to the widthwise direction. Each arm portion 31B has a tip end pivotally movably connected to the flap body 25B of the changeover flap 25. The pivot shaft portion 31C pivotally movably supports the main body portion 31A at the widthwise end portions thereof. The pivot shaft portion 31C is rotatably supported to the chute frame 27.

The pivot shaft portion 31C is positioned opposite to the rear cover 26 with respect to the second conveyer passage L2 in order to avoid mechanical interference with the sheet conveyed along the passage L2. Alternatively, the pivot shaft portion 31C is positioned offset from the second conveyer passage L2 in the widthwise direction to avoid the interference.

Each intersecting region between the changeover flap 25 and each holder arm 31 defines a linking portion 31D. At least one of the linking portions 31D, for example, a right side linking portion 31D is provided with a torsion spring 32 shown in FIG. 10 so as to resiliently urge the tip end portion 25C of the changeover flap 25 downward.

More specifically, one end portion and another end portion of the torsion spring are latched with the changeover flap 25 and the holder arm 31, respectively, and a center coil portion of the torsion spring is disposed over the linking portion 31D. Thus, the torsion spring 32 urges the changeover flap 25 and the holder arm 31 so as to reduce an intersection angle θ (FIGS. 4 and 11) defined therebetween. Instead of the torsion spring, a V-shaped leaf spring is available.

As shown in FIG. 11, the rear cover 26 has a first pressing portion 26C at a position corresponding to the first pressed portion 25D positioned opposite to the tip end portion 25C with respect to the linking portion 31D. The first pressing portion 26C is adapted to press the first pressed portion 25D toward the image forming unit 2 when the rear cover 26 is moving from its open position toward its close position.

A second pressed portion 31E is provided in the holder arm 31 at a position adjacent to the pivot shaft portion 31C. The rear cover 26 has a second pressing portion 26D at a position corresponding to the second pressed portion 31E to press the holder arm 31 toward the image forming unit 2 when the rear cover 26 is at the fully closed position.

That is, the first pressing portion 26C of the rear cover 26 presses the first pressed portion 25D of the changeover flap 25 toward the image forming unit 2 when the rear cover 26 is pivotally moving from the open position toward the closed position. Further, the second pressing portion 26D of the rear cover 26 presses the second pressed portion 31E of the holder arm 31 toward the image forming unit 2 when the rear cover 26 is at the fully closed position. In the latter case, the first pressing portion 26C is positioned away from a movable range of the first pressed portion 25D as shown in FIGS. 2 and 3 when the rear cover 26 is at its fully closed position.

At the fully closed position of the rear cover 26, the holder arm 31 is immovable due to interposition between the chute frame 27 and the second pressing portion 26D, whereas the changeover flap 25 is pivotally movable because the first pressing portion 26C is positioned offset from the movable range of the first pressed portion 25D.

At the fully closed position of the rear cover 26, the pivot shaft portion 31C and the linking portion 31D are arrayed vertically as shown in FIG. 3 such that the linking portion 31D and the pivot shaft portion 31C are positioned at the lower side of the changeover flap 25 and at the lower side of the holder arm 31, respectively. In this case, the changeover flap 25 and the holder arm 31 are almost linearly aligned with each other.

On the other hand, when the rear cover 26 is moved to its open position, the linking portion 31D is pivotally displaced downward about the pivot shaft portion 31C in synchronism with the pivotal movement of the rear cover 26. In this case, the changeover flap 25 and the holder arm 31 are displaced to provide a V-shape configuration as shown in FIGS. 4 and 11.

As shown in FIGS. 9 through 12, the support frame 27A of the chute frame 27 has a slide guide surface 27B so as to guide or regulate sliding movement of the tip end portion 25C of the changeover flap 25 in a predetermined direction. In accordance with the sliding movement, a posture of the changeover flap 25 can be changed.

With the above-described structure, the tip end portion 25C of the changeover flap 25 is urged to be moved about the linking portion 31D toward the image forming unit 2 (away from the rear cover 26) because of the biasing force of the spring 32 and gravity of the changeover flap 25. (A combination of the biasing force and the gravity will be referred to as a "moving force M2".)

Therefore, when the rear cover 26 is fully closed, the changeover flap 25 closes the outlet end 2A of the image forming unit 2 by the biasing force of the spring 32, i.e., closes the first conveyer passage L1 to provide a state where the sheet can be introduced into the second conveyer passage L2 as shown in FIG. 3.

When the sheet is discharged from the image forming unit 2, a leading edge of the sheet is brought into contact with the changeover flap 25, so that the changeover flap 25 is pushed upward in a direction away from the image forming unit 2 because of the conveying force of the sheet. That is, the changeover flap 25 is pivotally moved toward the rear cover 26 whereupon the second conveyer passage L2 is closed as shown in FIG. 2.

Since the slide guide surface 27B is facing the rear cover 26 and since the tip end portion 25C of the changeover flap 25 is urged toward the image forming unit because of the "moving force M2", the tip end portion 25C is pushed onto the slide guide surface 27B as shown in FIG. 4.

Accordingly, when the rear cover 26 is opened so that the holder arm 31 becomes pivotally movable upon moving the second pressing portion 26D away from the holder arm 31, the tip end portion 25C of the changeover flap 25 is pushed toward the slide guide surface 27B because of the moving force M2 and is displaced along the slide guide surface 27B. Therefore, the displacement of the tip end portion 25C is restricted in a direction D1 along the slide guide surface 27B.

On the other hand, since a pivot center of the holder arm 31, i.e., the pivot shaft portion 31C is immovable with respect to the chute frame 27, and since the moving force M2 urges the changeover flap 25 and the holder arm 31 to reduce the angle θ defined therebetween, the tip end portion 25C will be moved downward along the slide guide surface 27B while the linking portion 31D is displaced toward the rear cover 26 (from left side to right side in FIG. 11) when the rear cover 26 is opened.

That is, in accordance with opening movement of the rear cover 26, the linking portion 31D is displaced toward the rear cover 26 (away from the image forming unit 2, rightward in FIG. 11), whereas the changeover flap 25 is displaced toward the image forming unit (leftward in FIG. 11). Thus, the tip end portion 25C of the changeover flap 25 is displaced in a direction (direction D1) intersecting the displacing direction of the linking portion 31D in interlocking relation with the opening movement of the rear cover 26.

Accordingly, when the rear cover 26 is at the open position, the second conveyer passage L2 and the outlet end 2A of the image forming unit 2 (discharge side of the first conveyer roller 20A) are open as shown in FIG. 5. Thus, a sheet jammed at the first vertical passage L21 can be easily removed, and at the same time, the sheet formed with an image can be directly discharged out of the first conveyer roller 20A (The latter sheet will be referred to as "directly discharged sheet").

Further, when the rear cover 26 is at the open position, the tip end portion 25C of the changeover flap 25 is retracted to a position below the outlet end 2A of the image forming unit 2. Therefore, the changeover flap 25 can function as a sheet mounting portion 25E that mounts thereon the directly discharged sheet.

When the rear cover 26 is at its closed position, the changeover flap 25 is urged to be positioned toward the image forming unit 2 by the moving force M2 so as to close the first conveyer passage L1. As a result, the flap sensor 29 is turned ON (see FIG. 3). On the other hand, when the rear cover 26 is moved to the open position, the tip end portion 25C of the changeover flap 25 is displaced downward whereupon the first conveyer passage L1 is substantially opened and the flap sensor 29 is turned OFF (see FIG. 4).

A combination of the spring 32 and the holder arm 31 functions as a flap displacement mechanism that displaces the changeover flap 25 to open the first conveyer passage L1 when the rear cover 25 is opened.

Figure 13:
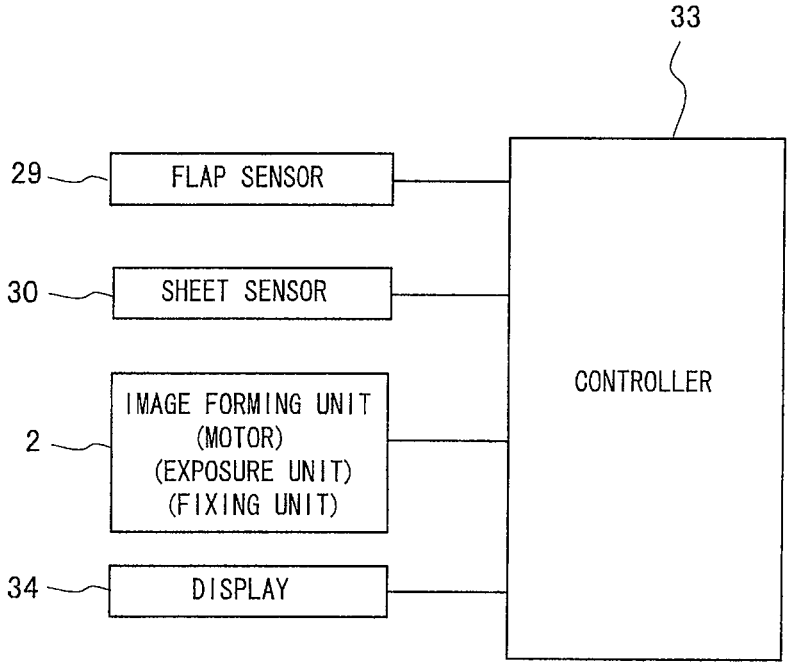
FIG. 13 is a block diagram showing an electrical connection in the image forming device according to the embodiment; and, FIG. 14 is a flowchart showing a sheet jam detection routine executed in the image forming device according to the embodiment.
Figure 14:
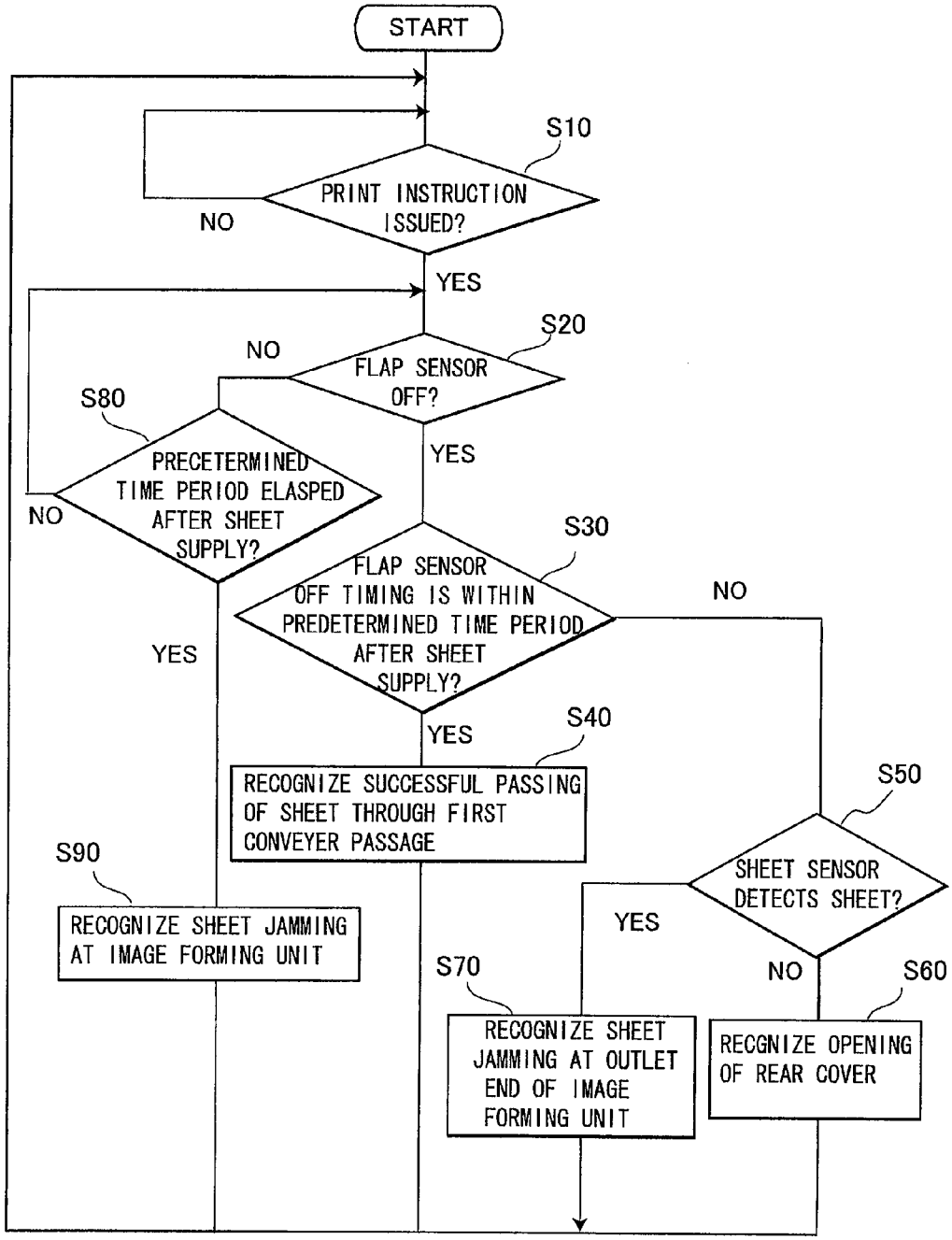

Next, operation of the flap sensor 29 and the sheet sensor 30 will be described with reference to FIGS. 13 and 14. A controller 33 is provided to which the flap sensor 29 and the sheet sensor 30 are connected as shown in FIG. 13. The controller 33 is a microcomputer including a CPU, a RAM and a ROM (non-volatile memory). A display 34 is provided at the front side of the outer frame 3 and is connected to the controller 33. The controller 33 is configured to control operation of the image forming unit 2 and the display 34 in accordance with a program stored in the ROM and in response to output signals from the sensors 29 and 30.

Further, the controller 33 executes further process based on the output signal from the flap sensor 29 and the sheet sensor 30. That is, upon turning ON a power switch (not shown) in the image forming device 1, a program for executing control process shown in FIG. 14 (sheet jam detection routine) is retrieved in the CPU, so that the CPU will continue execution of sheet jam detection routine until the power switch is turned OFF.

Upon starting the sheet jam detection routine, judgment is made as to whether or not a print instruction is issued from a user to the image forming device 1 (S10). If the print instruction has not been issued (S10: No), the processing S10 is again executed.

On the other hand, if the print instruction has been issued (S10:Yes), judgment is made as to whether or not the flap sensor 29 is at OFF state, i.e., whether or not the first conveyer passage L1 is open while the second conveyer passage L2 is closed (S20). If the judgment indicates that the flap sensor 29 is at OFF state (S20:Yes), determination is made as to whether or not a judgment timing at which the flap sensor 29 is at OFF state is within a predetermined time period range starting from the sheet supplying timing to the image forming unit 2 (S30).

That the determination in S30 falls affirmative implies that the OFF state of the flap sensor 29 is affirmed during a time period starting from a timing at which a leading end of the sheet is brought into contact with the flap sensor 29 and ending at a timing at which a trailing end of the sheet leaves the flap sensor 29 after the sheet is supplied to the image forming unit 2 as long as the sheet is normally conveyed.

If the determination indicates that the judgment timing at which the flap sensor 29 is at OFF state is within the predetermined time period (S30:Yes), the controller 33 recognizes that the sheet normally passes through the first conveyer passage L1 (S40), and then, the routine returns to S10.

On the other hand, if the determination indicates that the judgment timing at which the flap sensor 29 is at OFF state is out of the predetermined time period (S30:No), judgment is made as to whether or not the sheet sensor 30 detects the sheet (S50).

If the judgment indicates that the sheet sensor 30 detects the sheet (S50:Yes), the controller 33 recognizes that the sheet is jammed at the outlet end 2A of the image forming unit 2, and the sheet jamming is displayed at the display 34 (S70), and then, the routine returns to S10.

On the other hand, if the judgment made in S50 indicates that the sheet sensor 30 does not detect the sheet (S50:No), the controller recognizes that the rear cover 26 is open, and the open state is displayed at the display 34(S60), and then, the routine returns to S10.

If the judgment in S20 indicates that the flap sensor 29 is not at OFF state (S20:No), determination is made as to whether or not a predetermined time period has elapsed from a timing at which the sheet is supplied to the image forming unit 2, i.e., determination is made whether or not a time has come to make the leading end of the sheet to be brought into contact with the flap sensor 29 (S80).

If the determination in S80 indicates that the predetermined time period has not elapsed (S80:No), the routine proceeds back to S20. On the other hand, if the determination in S80 indicates that the predetermined time period has elapsed (S80:Yes), the controller 33 recognizes that the sheet jamming occurs at the image forming unit 2, and this sheet jamming is displayed at the display 34 (S90), and then, the routine returns to S10.

As described above in the depicted embodiment, when the rear cover 26 pivotally moves from its closed position to its open position, the angle θ defined between the holder arm 31 and the changeover flap 25 is changing while the linking portion 31D is pivotally displaced downward about the pivot shaft portion 31C. Accordingly, the sheet having been nipped between the rear cover 26 and the changeover flap 25 becomes free, so that application of excessive force to the changeover flap and to the sheet can be avoided to avoid damage to the changeover flap 25. Thus, a user can easily remove a jammed sheet to enhance operability.

Further, the slide guide surface 27B is provided for regulating displacement of the tip end portion of the 25C toward a predetermined direction. Therefore, stabilized displacement of the changeover flap 25 can be realized during opening and closing the rear cover 26, and opening and closing motion of the rear cover 26 can be enhanced.

Incidentally, if the first pressed portion 25D and the first pressing portion 26C are not provided, the holder arm 31 is pressed by the rear cover 26 during closure of the rear cover 26. In this case, the tip end portion 25C of the changeover flap 25 is forcibly pressed against the slide guide surface 27B to increase contacting pressure. Thus, sliding resistance may be increased. This requires larger force to close the rear cover 26. According to the depicted embodiment, since the first pressed portion 25D is provided at a position opposite to the tip end portion 25C with respect to the linking portion 31D, the changeover flap 25 is subjected to a moment M1 shown in FIG. 11 to urge the tip end portion 25C away from the slide guide surface 27B and a force F1 directing toward the image forming unit 2 is applied to the linking portion 31D when the rear cover 26 is pivotally moving from the open position to the close position.

Accordingly, inadvertent increase in contact pressure between the tip end portion 25C and the slide guide surface 27B can be restrained to lower the sliding resistance. Consequently, an excessive increase in force required for closing the rear cover 26 can be avoided.

Further, since the spring 32 generates urging force that urges the changeover flap 25 toward the image forming unit 2, the changeover flap 25 is positioned at the outlet end 2A of the image forming unit 2, i.e., the changeover flap 25 closes the first conveyer passage L1 to permit the sheet to be guided into the second conveyer passage L2 when the rear cover 26 is at the closed position.

Further, the tip end portion 25C of the changeover flap 25 is moved away form the outlet end 2A of the image forming unit 2 to open the outlet end 2A when the rear cover 26 is opened. Therefore, the sheet on which an image has been formed can be discharged outside directly from the image forming unit 2.

Further, at the closed position of the rear cover 26, the second pressed portion 31E is pressed by the second pressing portion 26D, while the second pressing portion 26D is positioned outside of the pivotally movable range of the first pressed portion 25D. Therefore, mobility of the changeover flap 25 will not be suppressed by the second pressing portion 26D while operation of the changeover flap 25 is properly ensured.

Further, at the open position of the rear cover 26, the changeover flap 25 can function as the sheet mounting portion 25E on which the sheet from the image forming unit 2 can be mounted. Thus, any scattering of the discharged sheets can be prevented.

Further, the pivot shaft 26B of the rear cover 26 is positioned lower than the inlet portion L24 of the horizontal passage section L22. With this structure, even if sheet jamming occurs with respect to the sheet passing through the second conveyer passage L2 in which the leading edge of the sheet already reaches the horizontal passage section L22, the jammed sheet can be easily removed from the second conveyer passage L2 after opening the rear cover 26.

Further, the flap sensor 29 is adapted to detect closure of one of the first conveyer passage L1 and the second conveyer passage L2 by the changeover flap 25 (in the depicted embodiment, the flap sensor 29 detects the closure of the first conveyer passage L1), and the changeover flap 25 is displaced to open the one of the first and second conveyer passages L1 and L2 (in the depicted embodiment, the changeover flap 25 is displaced to open the first conveyer passage L1) when the rear cover is opened.

With this structure, passing of the sheet through the conveyer passage can be detected as a result of the detection by the flap sensor 29 when the rear cover 26 is closed, and opening state of the rear cover 26 can be determined if the flap sensor 29 continuously detects for a long time period the opening state of the conveyer passage.

That is, passing of the sheet through the second conveyer passage L2 at the closed state of the rear cover can be determined when the closure of the first conveyer passage L1 is detected. On the other hand, passing of the sheet through the first conveyer passage L1 can be determined when the closure of the first conveyer passage L1 is detected shortly after the detection of the change from the closing state of the first conveyer passage L1 to the opening state thereof.

In this way, the image forming device makes much of the changeover flap 25 to avoid increase in numbers of parts and components, and passing of the sheet through the conveyer passage and opening or closing state of the rear cover 26 can be detected.

Incidentally, an electrical wiring to the flap sensor 29 is required. In the present embodiment, the flap sensor 29 is positioned opposite to the rear cover 26 with respect to the changeover flap 25. That is, the flap sensor 29 is positioned at the main body side. Therefore, a layout of the electrical wiring can be facilitated.

If the flap sensor 29 is provided at the rear cover 26, an elongated and complex wiring is required, and the flap sensor 29 may be damaged due to vibration attendant to opening and closing motion of the rear cover 26. In the illustrated embodiment, such drawbacks do not occur, since the flap sensor 29 is not provided at the rear cover 26.

Further, determination is made that the rear cover 26 is opened if the flap sensor 29 detects opening state of the first conveyer passage L1 as long as the passing of the sheet is not detected by the sheet sensor 30. Further, determination is made that sheet jamming occurs at the outlet end 2A in the first conveyer passage L1 if the flap sensor 29 detects opening state of the first conveyer passage L1 as long as the passing of the sheet is detected by the sheet sensor 30. Therefore, opening state of the rear cover 26 and the sheet jamming state can be clearly distinguished from each other without any increase in numbers of parts and components.

Various modifications are conceivable. For example, in the above-described embodiment, the linking portion 31D is provided at the lower portion of the changeover flap 25, and the pivot shaft portion 31C is provided at the lower portion of the holder arm 31. However, the upper portion of the changeover flap can be pivotally supported to a stationary portion, and a flap sensor can be provided to detect an intermediate portion of the changeover flap 25, and a holder arm has an upper portion pivotally connected to a lower portion of the changeover flap, and the holder arm has a lower free end portion to which a leading edge of the sheet is abuttable.

In the above-described modification, the urging force of the spring 32 should be set to allow the angle θ defined between the changeover flap and the holder arm to be increased when the rear cover 26 is opened. Further, in the above-described embodiment, the spring 32 is the torsion spring having one end engaged with the changeover flap 25 and the other en engaged with the holder arm 31. However, also available is a coil spring or a vortex spring having one end fixed to the changeover flap 25 and another end fixed to the chute frame 27 in order to apply a moving force M2 to the changeover flap 25. Alternatively, the spring 32 can be dispensed with so that moving force M2 applied to changeover flap 25 is provided by own weight (gravity) of the changeover flap 25.

Further, in the above-described embodiment, the tip end portion 25C of the changeover flap 25 is always pressed against the slide guide surface 27B because of the moving force M2. Thus, the slide guide surface 27B can function as a regulation mechanism for regulating the displacement of the tip end portion 25C toward the predetermined direction. However, another regulation mechanism can be provided by a pin provided at the tip end portion 25C and a groove or an elongated slot formed in the chute frame 27. The pin is movably engaged with the groove or slot.

Further, in the above-described embodiment, the first pressed portion 25D is provided in the first changeover flap 25. However, the first pressed portion 25D can be dispensed with. In the latter case, the second pressed portion 31E is pressed by the rear cover 26.

Further, in the above-described embodiment, opening state of the rear cover 26 and the sheet jamming state are distinguished from each other by employing the sheet sensor 30 and the flap sensor 29. However, the sheet sensor 30 can be dispensed with. In the latter case, the rear cover is determined to be opened if the opening state of the first conveyer passage L1 is detected for a relatively long period of time after the detection that the closing state of the first conveyer passage L1 is changed to the opening state.

Further, in the above-described embodiment, a conventional sensor is provided as the sheet sensor at the outlet side of the fixing unit 6. However, the conventional sensor can be positioned in or upstream of the image forming unit 2.

While the invention has been described in detail with reference to the embodiments thereof, it would be apparent to those skilled in the art that various changes and modifications may be made therein without departing from the spirit of the invention.

What is claimed is:

1. An image forming device for forming an image on adverse side and back side of a sheet, comprising:

an image forming unit that forms an image on the sheet, the image forming unit having an inlet end and an outlet end, a first conveyer passage extending from the outlet end to discharge the sheet out of the image forming unit;

a reverse-running mechanism positioned at the first conveyer passage to invert a feeding direction of the sheet having been conveyed along the first conveyer passage, a second conveyer passage being bifurcated from the first conveyer passage at a bifurcated portion and reaching the inlet end;

a changeover flap provided at the bifurcated portion and pivotally movable to a first position closing the first conveyer passage while opening the second conveyer passage and to a second position closing the second conveyer passage while opening the first conveyer passage, the changeover flap having a tip end portion;

a frame accommodating therein the image forming unit, the reverse-running mechanism and the changeover flap, the frame having an opening at which at least a part of the second conveyer passage is exposed to an outside;

a cover pivotally movable between a closed position closing the opening and an open position opening the opening, the cover defining a part of the second conveyer passage at the closed position; and a flap displacement mechanism comprising a pivot arm pivotally movable in interlocking relation to the pivotal movement of the cover, the pivot arm having a portion provided with a pivot shaft at a position opposite to the cover with respect to the second conveyer passage, and a free end portion provided with a linking portion to which the changeover flap is pivotally movably connected, the pivot arm and the changeover flap being configured to change an angle therebetween in accordance with the pivotal movement of the changeover flap and the pivot arm in interlocking relation to the pivotal movement of the cover from its closed position to its open position to displace the linking portion toward the cover.

2. The image forming device as claimed in claim 1, further comprising a regulation portion that regulates displacement of the tip end portion of the changeover flap to allow the tip end portion of the changeover flap to be displaced in a predetermined direction.

3. The image forming device as claimed in claim 2, wherein the regulation portion includes a slide guide surface facing a side opposite to the image forming unit, the tip end portion of the changeover flap being slidingly contactable with the slide guide surface; and, wherein the changeover flap has a first pressed portion at a position opposite to the tip end portion thereof with respect to the linking portion, the first pressed portion being configured to be pressed by the cover during pivotal movement of the cover from its open position to its closed position.

4. The image forming device as claimed in claim 3, wherein the flap displacement mechanism further comprises a biasing member that urges the tip end portion of the changeover flap to be displaced toward the slide guide surface.

5. The image forming device as claimed in claim 3, wherein the cover has a first pressing portion protruding toward the image forming unit and contactable with the first pressed portion.

6. The image forming device as claimed in claim 1, wherein the opening is positioned in alignment with the outlet end of the image forming unit; and, wherein the flap displacement mechanism further comprises a biasing member that urges the changeover flap to be displaced toward the image forming unit.

7. The image forming device as claimed in claim 1, wherein the cover has a second pressing portion protruding toward the image forming unit to press the pivot arm in a direction from the cover to the image forming unit at the closed position of the cover.

8. The image forming unit as claimed in claim 1, wherein the changeover flap has a lower portion at which the linking portion is provided; and, wherein the pivot arm has a lower end portion at which the pivot shaft is provided.

9. The image forming unit as claimed in claim 8, wherein the tip end portion of the changeover flap is positioned lower than the outlet end of the image forming unit when the cover is open whereupon the changeover flap functions as a part of a sheet mount portion that receives an image-carrying-sheet discharged out of the outlet end of the image forming unit when the cover is at the open position.

10. The image forming unit as claimed in claim 1, wherein the second conveyer passage has a vertical passage section extending downward from the bifurcated portion and having a lowermost end, and a horizontal passage section extending horizontally from the lowermost end and having an inlet portion; and wherein the cover has a pivotal center positioned lower than the inlet portion.

11. The image forming unit as claimed in claim 1, wherein the image forming unit is an electro-photographic type unit having a transferring portion that transfers developing agent to the sheet to form a visible image and thermal fixing portion that fixes the visible image to the sheet.

12. The image forming device as claimed in claim 1, wherein the flap displacement mechanism is configured to displace the changeover flap to open one of the first conveyer passage and the second conveyer passage when the cover is opened; and the image forming device further comprising:

a flap sensor that performs detection as to whether or not the changeover flap shuts off one of the first conveyer passage and the second conveyer passage; and a determination device that determines, based on the detection, whether or not the sheet has moved past one of the first conveyer passage and the second conveyer passage and determines whether or not the cover is opened.

13. The image forming device as claimed in claim 12, wherein the changeover flap is configured to shut off the one of the first conveyer passage and the second conveyer passage in a state where the cover is at the closed position and in a state other than a state where the sheet is passing through the one of the first conveyer passage and the second conveyer passage.

14. The image forming device as claimed in claim 12, wherein the flap sensor is positioned opposite to the cover with respect to the changeover flap.

15. The image forming device as claimed in claim 12, further comprising a sheet sensor positioned at the first conveyer passage and upstream of the bifurcated portion; and wherein the determination device determines, based on the detection from the flap sensor and detection from the sheet sensor, whether or not the sheet has moved past the first conveyer passage.

16. The image forming device as claimed in claim 15, wherein the determination device comprises:

a first judging part that judges whether or not the flap sensor is rendered in an OFF state, indicating an opening state of the changeover flap with respect to the first conveyer passage;

a second judging part that judges whether or not a judgment timing at which the flap sensor is at the OFF state is within a predetermined time period range starting from a sheet supplying timing to the image forming unit, if the OFF state of the flap sensor is detected in the first judging part;

a first recognizing part recognizing that the sheet normally passes through the first conveyer passage if the judgment timing is within the predetermined time period in the second judging part;

a third judging part that judges whether or not a time has come to make a leading end of the sheet to be brought into contact with the flap sensor if the flap sensor is rendered in an ON state in the first judging part: and a second recognizing part recognizing sheet jamming occurring at the image forming unit.

17. The image forming device as claimed in claim 16 wherein the determination device further comprises:

a fourth judging part that judges whether or not the sheet sensor detects the sheet if the judgment timing is outside of the predetermined time period in the second judging part;

a third recognizing part recognizing opening state of the rear cover if the sheet sensor does not detect the sheet in the fourth judging part; and a fourth recognizing part recognizing sheet jamming at the outlet end of the image forming unit.

18. The image forming device as claimed in claim 12, further comprising a sheet sensor positioned at a sheet passage upstream of the first conveyer passage to detect passing of a sheet; and wherein the determination device determines, based on the detection from the flap sensor and detection from the sheet sensor, whether or not the sheet has moved past the first conveyer passage.

19. The image forming device as claimed in claim 1, wherein the changeover flap is supported to the frame; and wherein the cover is pivotally movable relative to the frame, and the pivotal movement of the cover is independent of the pivotal movement of the changeover flap.

* * * * *

UNITED STATES PATENT AND TRADEMARK OFFICE

CERTIFICATE OF CORRECTION

PATENT NO. : 8,452,197 B2
APPLICATION NO. : 12/709608
DATED : May 28, 2013
INVENTOR(S) : Tomatsu It is certified that error appears in the above-identified patent and that said Letters Patent is hereby corrected as shown below:

On the Title Page; Item [73]:

Please delete "Banner & Witcoff, Ltd." and insert --Brother Kogyo Kabushiki Kaisha--

Signed and Sealed this
Eighth Day of April, 2014

Michelle K. Lee

Michelle K. Lee
*Deputy Director of the United States Patent and Trademark Office*